US007580018B2

(12) United States Patent
Takeda et al.

(10) Patent No.: US 7,580,018 B2
(45) Date of Patent: Aug. 25, 2009

(54) LIQUID CRYSTAL DISPLAY APPARATUS AND METHOD OF DRIVING LCD PANEL

(75) Inventors: Hiroshi Takeda, Kanagawa (JP); Machihiko Yamaguchi, Tokyo (JP)

(73) Assignee: NEC LCD Technologies, Ltd, Kanagawa (JP)

( * ) Notice: Subject to any disclaimer, the term of this patent is extended or adjusted under 35 U.S.C. 154(b) by 846 days.

(21) Appl. No.: 10/829,177

(22) Filed: Apr. 22, 2004

(65) Prior Publication Data

US 2004/0212577 A1 Oct. 28, 2004

(30) Foreign Application Priority Data

Apr. 24, 2003 (JP) ..... 2003-120592

(51) Int. Cl.
*G09G 3/36* (2006.01)

(52) U.S. Cl. ..... 345/87; 345/99

(58) Field of Classification Search ..... 345/87, 345/97–100, 204, 211, 212
See application file for complete search history.

(56) References Cited

U.S. PATENT DOCUMENTS 5,670,973 A * 9/1997 Bassetti et al. ..... 345/58
6,175,351 B1 1/2001 Matsuura et al.
6,519,013 B1 * 2/2003 Nagai et al. ..... 349/33
6,727,878 B2 4/2004 Okuzono et al.
6,750,840 B2 * 6/2004 Morita ..... 345/100
6,977,967 B1 12/2005 Tiedemann, Jr. et al.
6,980,190 B2 * 12/2005 Ueda ..... 345/96
6,982,693 B2 1/2006 Okuzono et al.

FOREIGN PATENT DOCUMENTS

JP 62-0433622 A 2/1987
JP 07-056143 A 3/1995
JP 10-232651 A 9/1998
JP 2001-215469 A 8/2001
JP 2003-182616 A 6/2002

* cited by examiner

*Primary Examiner*—Abbas I Abdulselam
(74) *Attorney, Agent, or Firm*—Sughrue Mion, PLLC

(57) ABSTRACT

In a liquid crystal display apparatus, a set of write-in voltages are generated corresponding to a horizontal line signal of an input video frame so that they appear at end points of the column lines of a LCD panel. The row lines of the LCD panel are successively selected and the write-in voltages are supplied from the end points of the column lines to the liquid crystal cells of the selected row line for a variable write-in period. In order to compensate for shades-of-gray differences between the top and bottom of the LCD panel, the write-in period is increasingly varied as a function of the geometric distance from the selected row line to the end points of the column lines. The write-in period may be increasingly variable from a nominal value, or from a less-than-nominal value to the nominal value, or a combination of both.

26 Claims, 13 Drawing Sheets

TIMING CONTROLLER

TIMING CONTROLLER

LIQUID CRYSTAL DISPLAY APPARATUS AND METHOD OF DRIVING LCD PANEL

BACKGROUND OF THE INVENTION

1. Field of the Invention

The present invention relates to a liquid crystal display apparatus and a method of driving a liquid crystal display panel.

2. Description of the Related Art

A liquid crystal display panel comprises a matrix array of pixels each being formed by a switching transistor and a liquid crystal cell. All switching transistors are connected to intersections of column lines and row lines which are successively selected. When one of the row lines is selected, the column lines are respectively driven by write-in voltages. With the advancing technology in the field of flat panel displays, the recent tendency is toward developing large sized, high definition display panels. As the screen size increases, the write-in voltages must travel through the increased length of the column lines. Since the write-in voltages are supplied to the liquid crystal cells of the selected row line for a fixed write-in period, they suffer from undesirable attenuation and distortion, causing different shades of gray to occur between the top and bottom of the screen as illustrated in FIG. 1.

To overcome this problem, Japanese Patent Publication 2002-182616 discloses a technique whereby variable supplemental voltages are generated and combined with write-in voltages. The combined voltages vary increasingly with the distance between the selected row line to the end points where the combined voltages are supplied.

However, because of the analog circuitry, difficulty arises to provide precision circuit adjustment. Therefore, a need exists to provide a solution whereby circuit adjustment can be easily and precisely performed on liquid crystal display apparatus.

SUMMARY OF THE INVENTION

It is therefore an object of the present invention to provide a liquid crystal display apparatus and a method of driving a liquid crystal display panel by controlling the write-in period according to different distances traveled along the column lines by the write-in voltages. Since the pulse duration can be easily controlled by digital circuitry, the present invention solves the problem of different shades of gray across the screen of a liquid crystal display.

According to a first aspect of the present invention, there is provided a liquid crystal display apparatus comprising a liquid crystal display panel a liquid crystal display panel comprising a matrix array of transistors and a matrix array of liquid crystal cells respectively connected to the transistors, the transistors being respectively connected to intersections of a plurality of column lines and a plurality of row lines for activating the liquid crystal cells, and a driving circuit for successively generating a plurality of write-in voltages of a line signal of a video frame at end points of the column lines, successively selecting each of the row lines and supplying the write-in voltages from the end points of the column lines to the liquid crystal cells of the selected row line for a variable write-in period corresponding to a geometric distance from the selected row line to the end points. The write-in period may be increasingly variable from a nominal value or increasingly variable from a less-than-nominal value to the nominal value or a combination of both.

According to a second aspect, the present invention provides a method of driving a liquid crystal display, wherein the liquid crystal display panel comprises a matrix array of transistors and a matrix array of liquid crystal cells respectively connected to the transistors, the transistors being respectively connected to intersections of a plurality of column lines and a plurality of row lines for activating the liquid crystal cells. The method comprises the steps of (a) generating a plurality of write-in voltages of a line signal of a video frame so that the write-in voltages appear at end points of the column lines, (b) successively selecting one of the row lines, and (c) successively supplying the write-in voltages from the end points of the column lines to the liquid crystal cells of the selected row line for a write-in period corresponding to the geometric distance from the selected row line to the end points.

BRIEF DESCRIPTION OF THE DRAWINGS

The present invention will be described in detail further with reference to the following drawings, in which.

DETAILED DESCRIPTION

Figure 1:
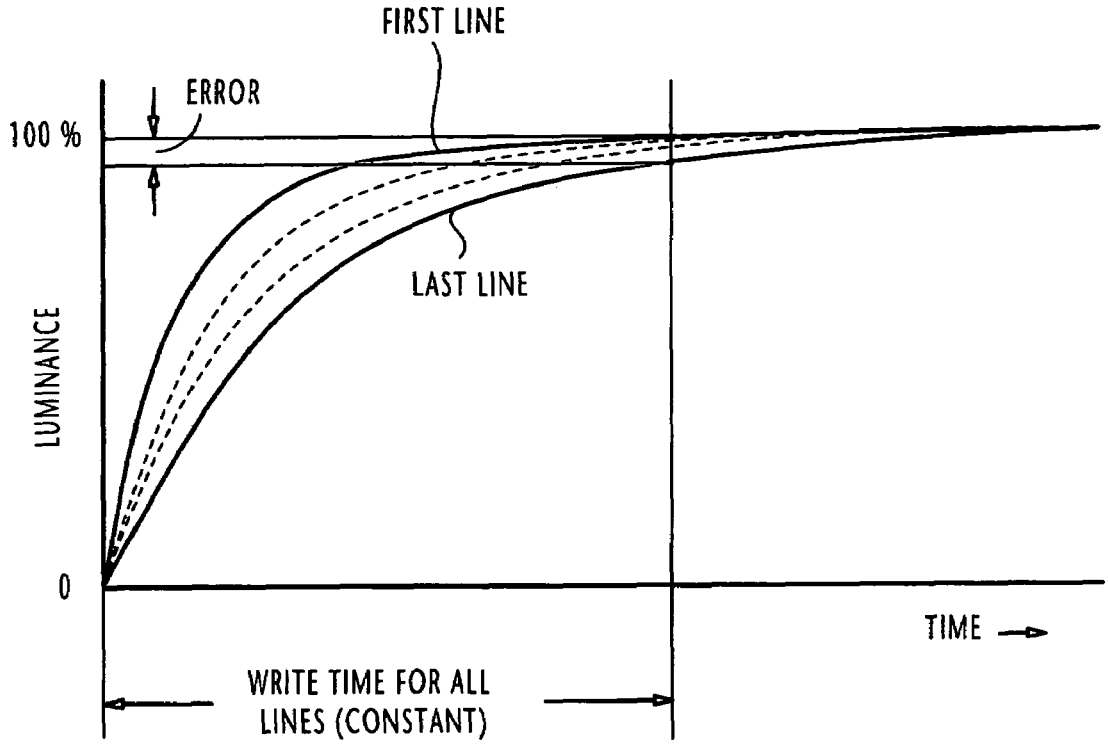
FIG. 1 PRIOR ART
FIG. 1 is a graphic representation of a prior art liquid crystal display panel in which luminance values are plotted as a function of time to illustrate a luminance error between the first and last lines.
Figure 2:
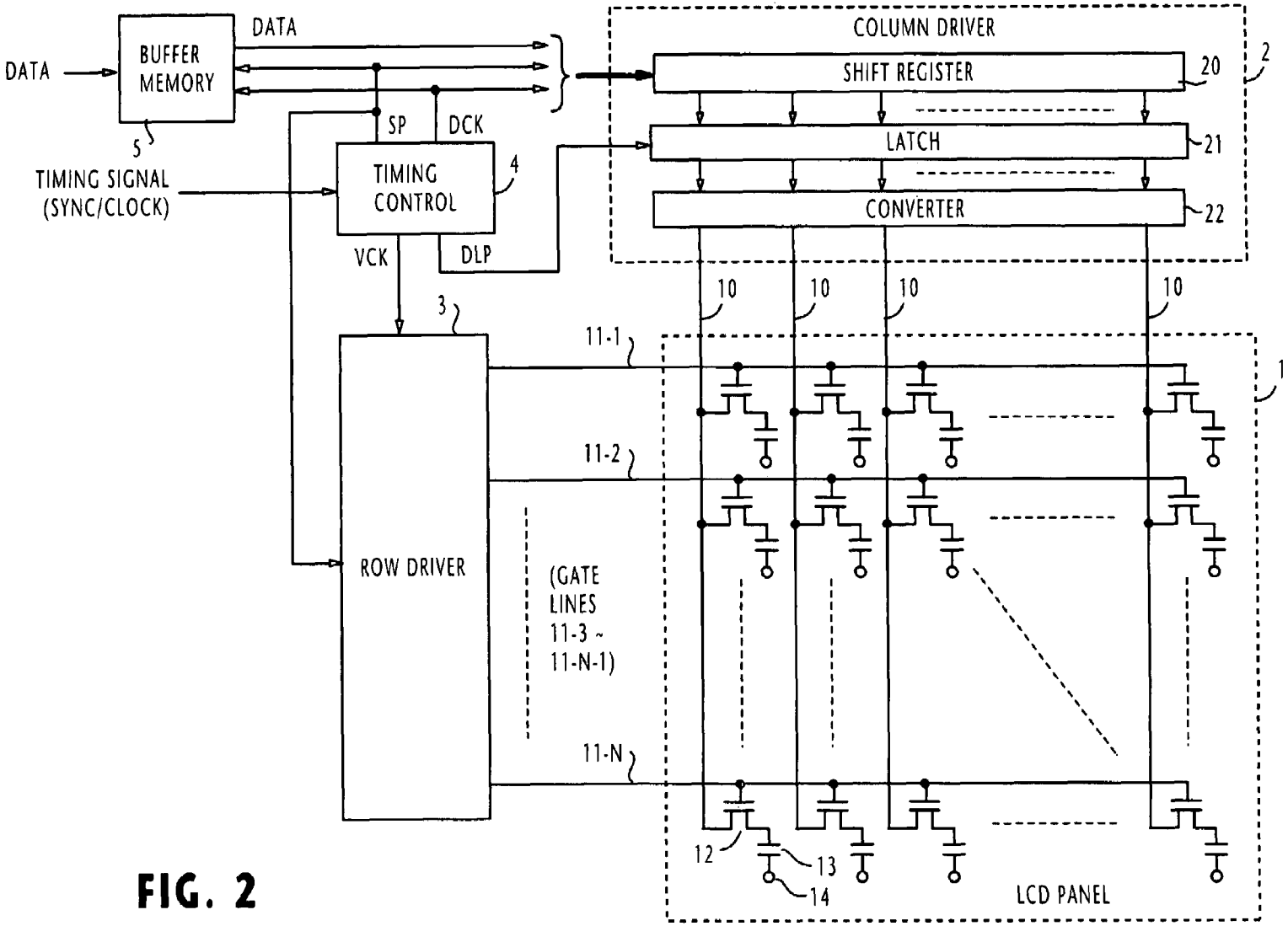
FIG. 2 is a block diagram of an LCD drive circuit according to a first embodiment of the present invention.

Referring now to FIG. 2, there is shown an LCD drive circuit according to a first embodiment of the present invention. The drive circuit comprises a column driver 2 and a row driver 3 for respectively driving a liquid crystal display panel 1 in response to timing pulses supplied from a timing controller 4. In the first embodiment, the vertical blanking interval of each frame is utilized to stretch gate control pulse longer than the usual gate-on time. For this purpose, a buffer memory 5 is provided for temporarily storing video input data from an external source, not shown. The stored video data is supplied line-by-line to the column driver 2. Input timing signal (sync and clock) is also supplied from the external source to the timing controller 4.

The LCD panel 1 is comprised of a plurality of column (drain) lines 10 connected to the column driver 2 for receiving video signals, a plurality of horizontal row (gate) lines 11-1~11-N connected to the row driver 3 for receiving a gate control pulse. A matrix array of picture elements (pixels) are located at intersections of the column lines 10 and the row lines 11. Each pixel comprises a thin-film transistor 12 and a liquid crystal cell 13. In each pixel, the transistor 12 connects its drain to the associated column line 10 and its gate to the associated row line 11, and the liquid crystal cell 13 is connected between the source of the transistor 12 and a common electrode 14.

As will be described below, the gate control pulse is shifted from one row line to the next in response to a gate drive clock pulse (VCK) from the timing controller 4. The duration of each gate control pulse begins at the leading edge of a VCK pulse and ends at the leading edge of the next VCK pulse. In the presence of a gate control pulse, a line signal of a video frame supplied to the column driver 2 is latched in response to a data latch pulse (DLP). A "write-in period" of a selected row line is defined between the trailing edge of a DLP pulse and the leading edge of a VCK pulse for writing the latched line signal into the liquid crystal cells 13 of a selected row line 11. By increasing varying the interval between successive VCK pulses according to the geometric distance from a selected row line to the column driver 2 along the column lines 10, the write-in period is increasingly varied as the point of selection proceeds from the row line 11-1 to the row line 11-N.

All liquid crystal cells 13 are air-tightly sealed in a transparent flat panel, not shown, and the column lines 10, the row lines 11 and the transistors 12 are arranged on one side of the flat panel and the common electrodes 14 and a color filter are arranged on the other side. Each liquid crystal cell 13 corresponds in position to each dot of the screen and is capable of charging a "write-in" voltage supplied from the column driver 2 when the associated switching transistor 12 is turned on in response to a gate control pulse from the row driver 3. When the transistor 12 is turned off at the trailing edge of the gate control pulse, the associated liquid crystal cell 13 holds the write-in voltage until the end of a frame period.

All the common electrodes 14 are usually biased at a constant voltage of 7 volts. Using this bias voltage as a reference, the polarity of the write-in voltage is determined. Usually, a positive write-in voltage varies in the range between 8 and 13 volts and a negative write-in voltage varies in the range between 1 and 6 volts. Thus, the write-in voltage varies in a range from 1 to 6 volts on either side of the 7-volt reference voltage.

In the first embodiment, the column driver 2, also known as a source driver, includes a shift register 20, a latch circuit 21 and a conversion circuit 22. Shift register 20 responds to a start pulse (SP) from the timing controller 4 for receiving video data which is serially clocked pixel-by-pixel in response to a dot clock pulse (DCK). When all pixel data of a line are clocked into the shift register 20, they are supplied in parallel to the latch circuit 21 in response to the leading edge of a data latch pulse (DLP) from the timing controller 4. Conversion circuit 22 performs the conversion of individual pixel data into write-in voltages and drives the column lines 10 with the write-in voltages via appropriate impedance matching circuits.

Row driver 3, which is also known as a gate driver which responds to the start pulse (SP) and a gate-drive clock pulse (VCK) from the timing controller 4 for sequentially selecting the row lines 11-1~11-N so that each row line is selected between the leading edge of the corresponding VCK pulse and the leading edge of the next VCK pulse. For each row line 11-i (i=1, 2, . . . N), each of the SP, VCK and DLP pulses is generated at intervals increasingly variable as a function of the geometric distance along the column lines 10 from the selected row line 11-i to the column driver 2.

Figure 3:
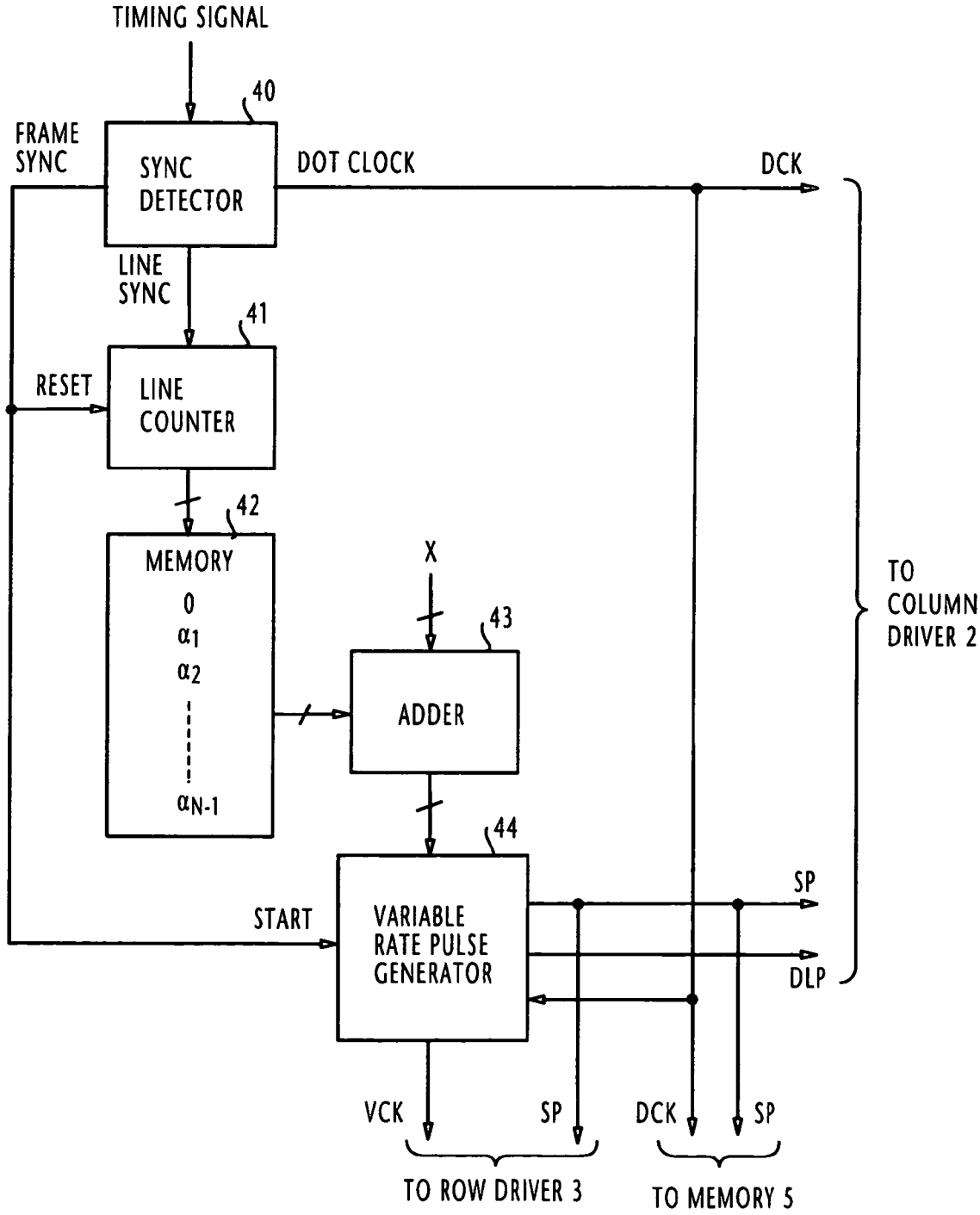
FIG. 3 is a block diagram of the timing controller of FIG. 2.

As shown in FIG. 3, the timing controller 4 of the first embodiment comprises a sync detector 40 for discriminating the input clock and sync timing signals to detect the frame sync and line sync timing of the input video frame and produces a dot clock pulse DCK. A line counter 41, which is reset when a frame sync is detected, increments a count number each time a line sync is detected and provides a binary line-count number to a memory 42. Write-in additive timing values 0, $\alpha_1$ through $\alpha_{N-1}$ are stored in the memory 42, respectively corresponding to row lines 11-1, 11-2 through 11-N. Each of the additive timing values $\alpha_1$ through $\alpha_{N-1}$ is determined as a function of the geometric distance from a corresponding one of the row lines 11-2~11-N to the column driver 2 along the column lines 10. Note that the total number of DCK pulses assigned to these additive timing values is equal to (M−N)×G, where M−N is the number of lines which can be generated within the vertical blanking interval and G is the number of DCK pulses during each line interval.

Each additive variable is read from the memory 42 in response to a corresponding line-count number and supplied to an adder 43 where the additive variable is summed with an integer X, where X is the nominal value of the write-in period. The binary output of the adder 43 is connected to a variable rate pulse generator 44. This variable rate pulse generator may be implemented with a presettable counter which increments a count number in response to the DCK pulse and produces an output when that count number equals some preset value, which is set equal to the output of adder 43. Variable rate pulse generator 44 produces SP, VCK and DLP pulses, each of which occurs at intervals varying increasingly as the row lines 11-1~11-N are selected in sequence in that order. All of these variable-rate pulses have a fixed time difference from one another. Initially, the variable rate pulse generator 44 is activated to produce a first VCK pulse when the sync generator 40 detects a frame sync.

The variable-rate SP and VCK pulses are supplied to the row driver 3 and the variable-rate SP and DLP (data latch) pulses are supplied to the column driver 2 along with constant-rate DCK (dot clock) pulse which is supplied from the sync detector 40. The SP and DCK pulse are also supplied from the timing controller 4 to the buffer memory 5 so that stored video data can be read line-by-line into the column driver 2 when a row line is selected.

Figure 4:
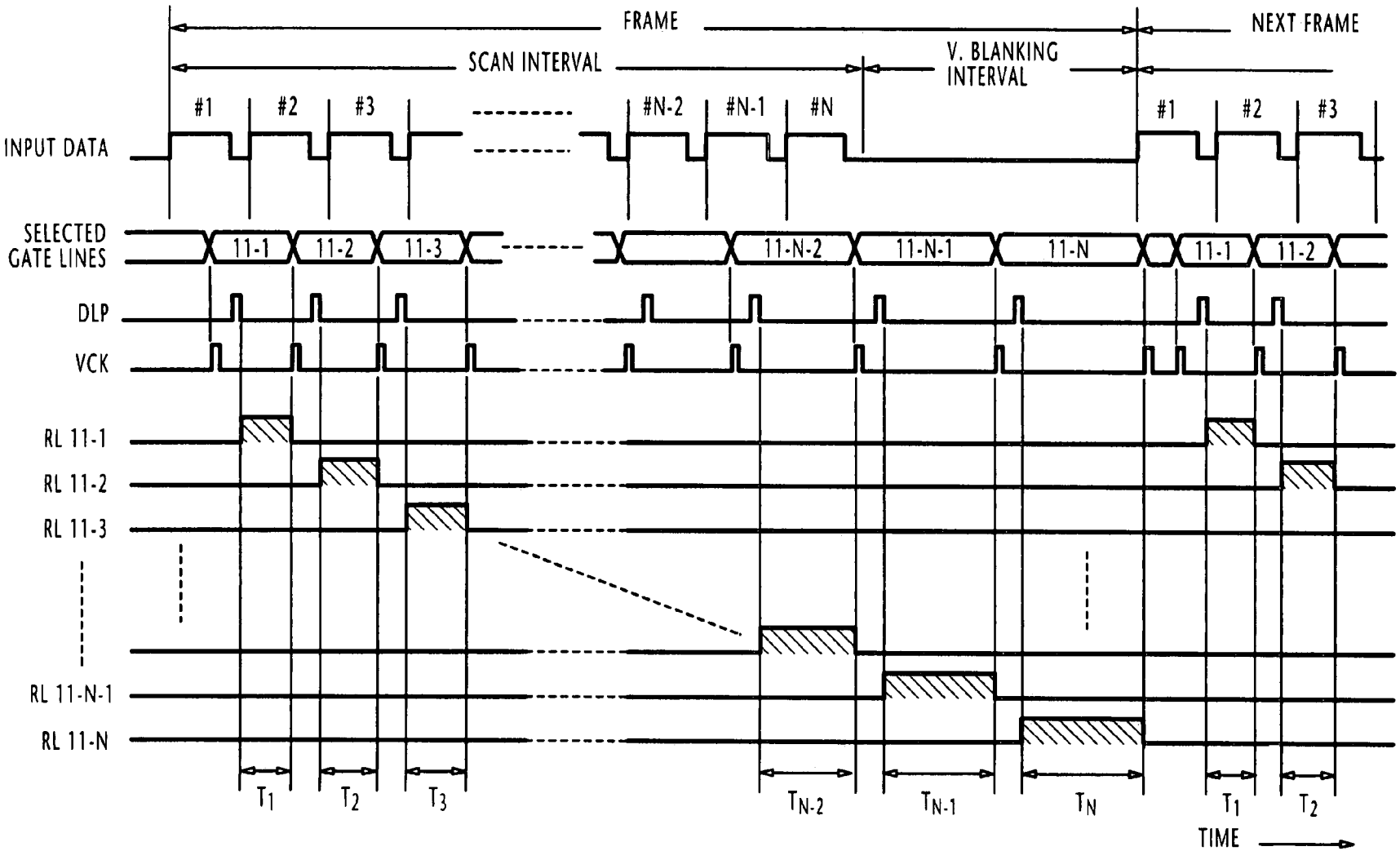
FIG. 4 is a timing diagram of the operation of FIG. 3.

The operation of the first embodiment of the present invention is best understood with the following description with reference to the timing diagram of FIG. 4.

As shown in FIG. 4, a frame interval is divided into a vertical scan interval and a vertical blanking interval. During the vertical scan interval, each of the #1 to #N line signal of a video frame is sequentially read into the buffer memory 5.

In response to a variable-rate start pulse SP, a line signal is read out of the buffer memory 5 and clocked into the column-driver shift register 20 and stored in the latch circuit 21 in response to a variable-rate DLP pulse. Row driver 3 selects one of the row lines 11-i in response to the same start pulse and generates a gate control pulse in response to a variable-rate VCK pulse to drive the selected row line 11-i. In this way, the row lines 11-1 through 11-N are successively rendered active for periods $T_1, \ldots, T_N$.

Figure 5:
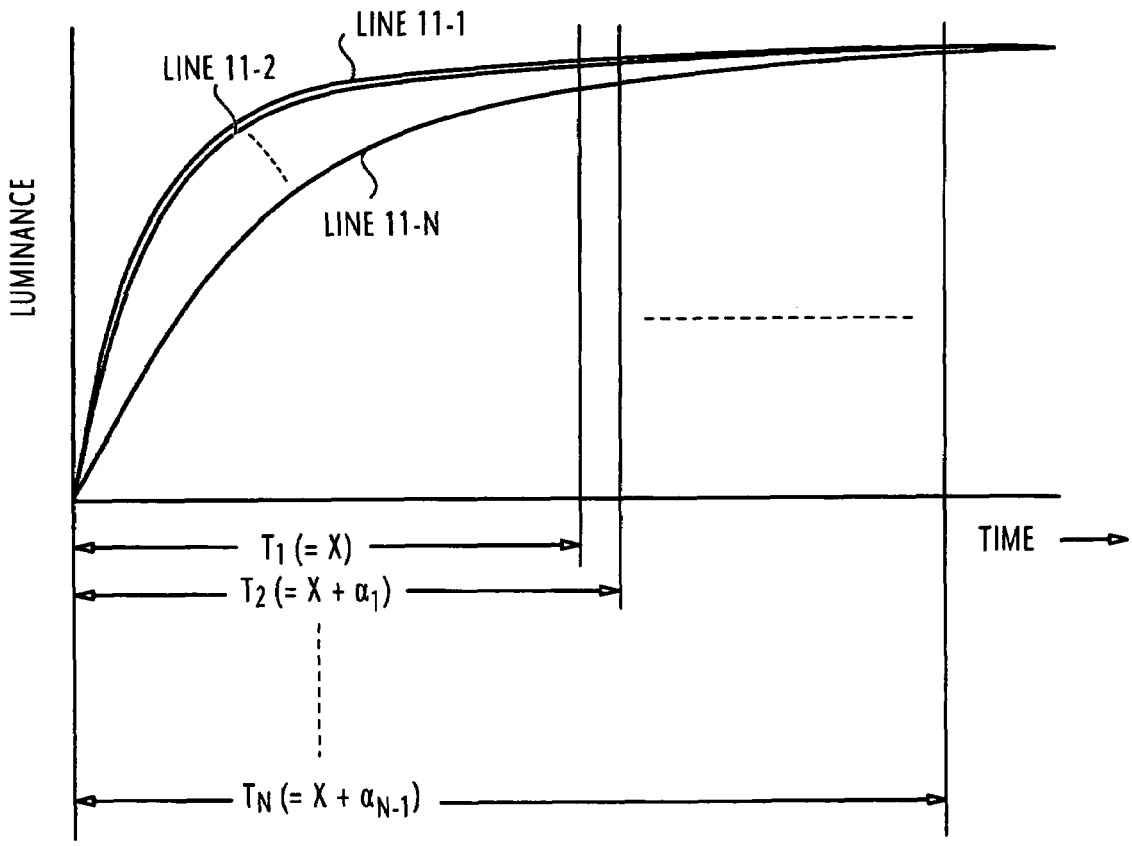
FIG. 5 is a graphic representation of the luminance-versus-time characteristics of the first embodiment of the present invention.

In the prior art, the write-in period is fixed at the nominal interval (X) for all row lines. As shown in FIG. 5, the write-in periods of row lines 11-1, 11-2, . . . , 11-N are respectively set equal to X, X+$\alpha_1$, . . . , X+$\alpha_{N-1}$. As a result, the distance-associated different voltage drops along the column lines 10 is compensated. For a given write-in voltage, the light intensities of all liquid crystal cells 10 are rendered substantially equal to each other.

Since the pulse interval can be easily controlled by the use of the digital circuitry, the variable intervals of the SP, DLP and VCK pulses can be precisely controlled to eliminate the undesired differences in shades of gray between the top and bottom lines on the monitor screen. The precision timing control is particularly important since the time assigned for each write-in operation is becoming increasingly limited with the current tendency toward developing high resolution, large-screen displays.

Figure 6:
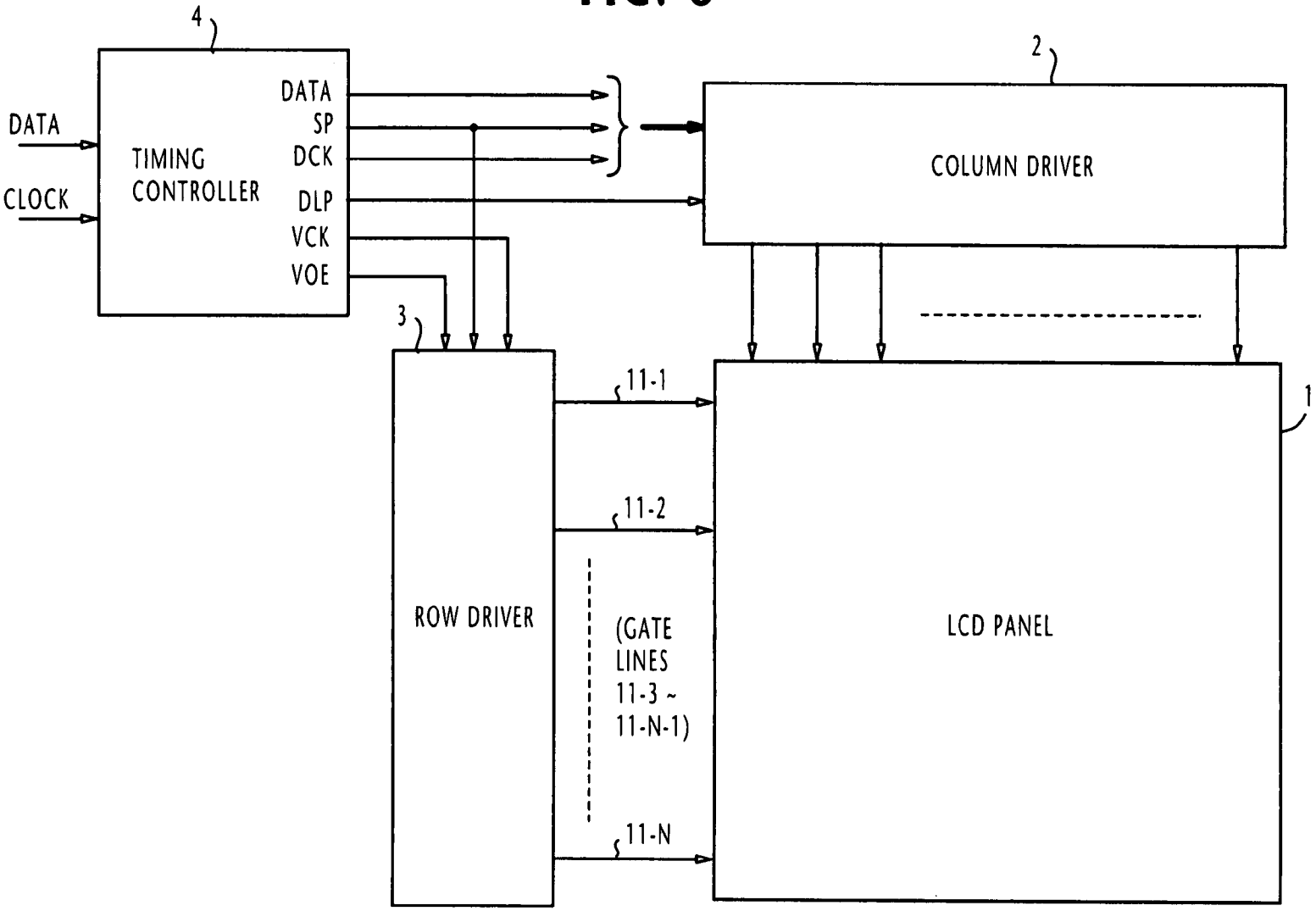
FIG. 6 is a block diagram of an LCD drive circuit according to a second embodiment of the present invention.

A second embodiment of the present invention is shown in FIG. 6. In this embodiment, the write-in operations of the row lines 11-1 to 11-N are respectively performed within periods $T_1=X-\beta_1$, $T_2=X-\beta_2$, . . . , $T_{N-1}=X-\beta_{N-1}$, and $T_N=X$, where $\beta_1 \geqq \beta_2 \geqq$ . . . , $\beta_{N-2} \geqq \beta_{N-1}$, and $\beta_i$ (i=1, . . . , N−1) is a subtractive timing value which varies decreasingly as a function of geometric distance along the column lines between the row line 11-i and the column driver 2. Therefore, the write-in period $T_i=X-\beta_i$ varies increasingly, within the nominal write-in period X, as a function of the geometric distance along the column lines between the row line 11-i and the column driver 2. The write-in operation is thus performed within an interval smaller than the horizontal line interval of the input video frame.

Since the write-in operation of the liquid crystal elements 13 does not take longer than the time for writing the input line data into the shift register 20, the buffer memory of the previous embodiment is not necessary in this embodiment.

In the second embodiment, VCK and DLP pulses are generated at constant intervals and a video output enable (VOE) pulse is generated at intervals increasingly variable as a function of the geometric distance from the row lines to the column driver 2. In the row driver 3, each gate control pulse is generated so that its begins in response to the constant-rate VCK pulse and ends in response to the VOE pulse.

Figure 7:
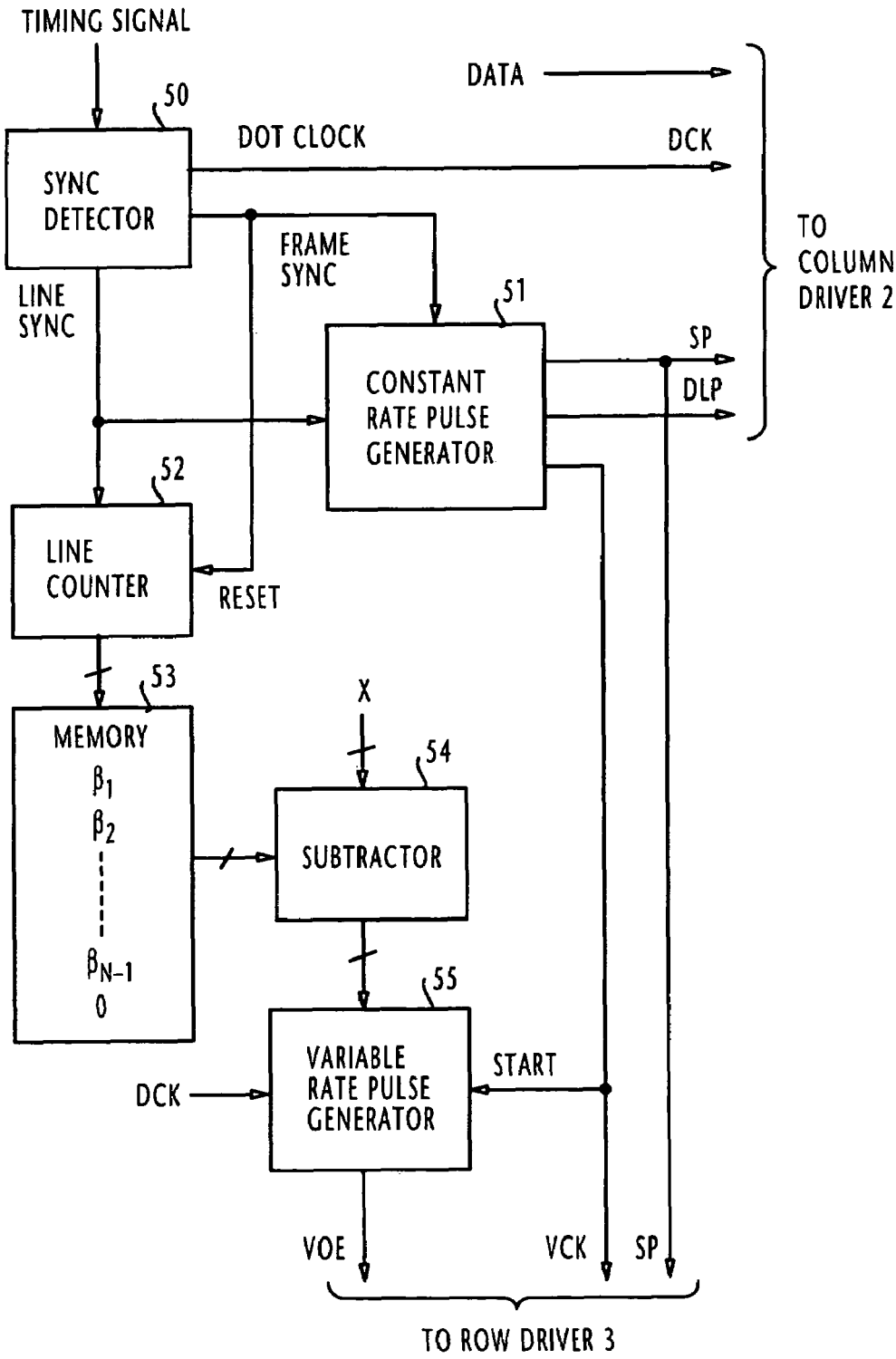
FIG. 7 is a block diagram of the timing controller of FIG. 6.

As shown in detail in FIG. 7, the timing controller 4 of the second embodiment comprises a sync detector 50 for discriminating the input clock and sync timing signals to detect the frame sync and line sync timing of the input video frame and the dot clock pulse DCK. A constant-rate pulse generator 51 responds to the detected frame and line sync timing for producing a start pulse (SP), a DLP pulse and a VCK pulse at constant intervals. A line counter 52, which is reset by a frame sync, increments a count number each time a line sync is detected and provides a binary line-count number to a memory 53. Write-in subtractive timing values $\beta_1$ through $\beta_{N-1}$ and "0" are stored in the memory 53 respectively corresponding to row lines 11-1, . . . , 11-N-1, and 11-N.

Each subtractive timing value is read from the memory 53 in response to a corresponding line-count number and supplied to a subtractor 54 where the subtractive timing value is subtracted from the nominal value X. The binary output of the subtractor 54 is then used to preset a variable rate pulse generator 55. Variable rate pulse generator 55 responds to a constant-rate VCK pulse by starting the count of DCK pulses and generates a VOE pulse when the count number equals the preset value.

The variable-rate VOE pulse and the constant rate SP and VCK pulses are supplied to the row driver 3 and the constant-rate SP and DLP pulses are supplied to the column driver 2 along with the input video frame (data) and DCK pulse.

Figure 8:
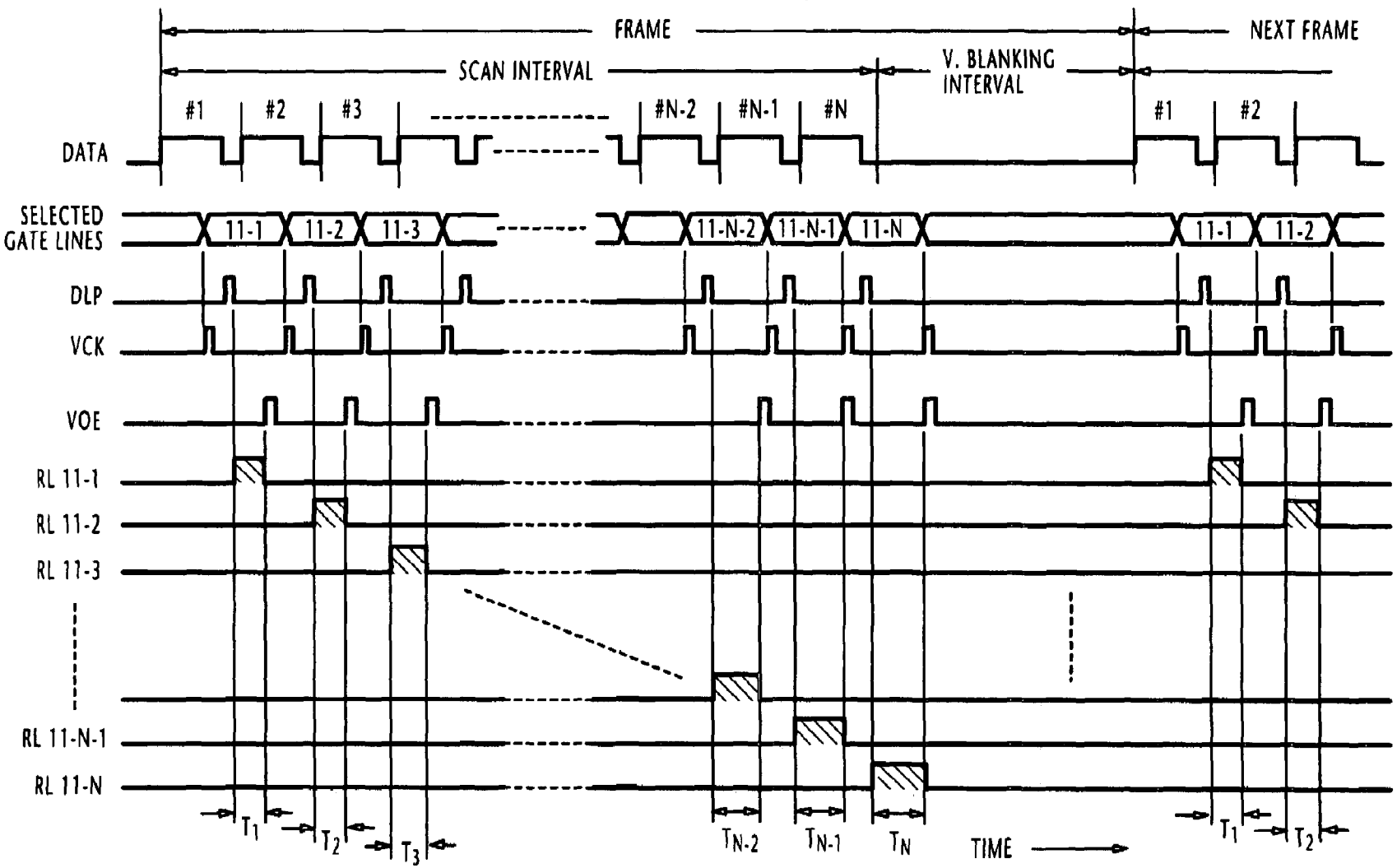
FIG. 8 is a timing diagram of the operation of FIG. 6.

The operation of the second embodiment of the present invention proceeds according to the timing diagram of FIG. 8.

Figure 9:
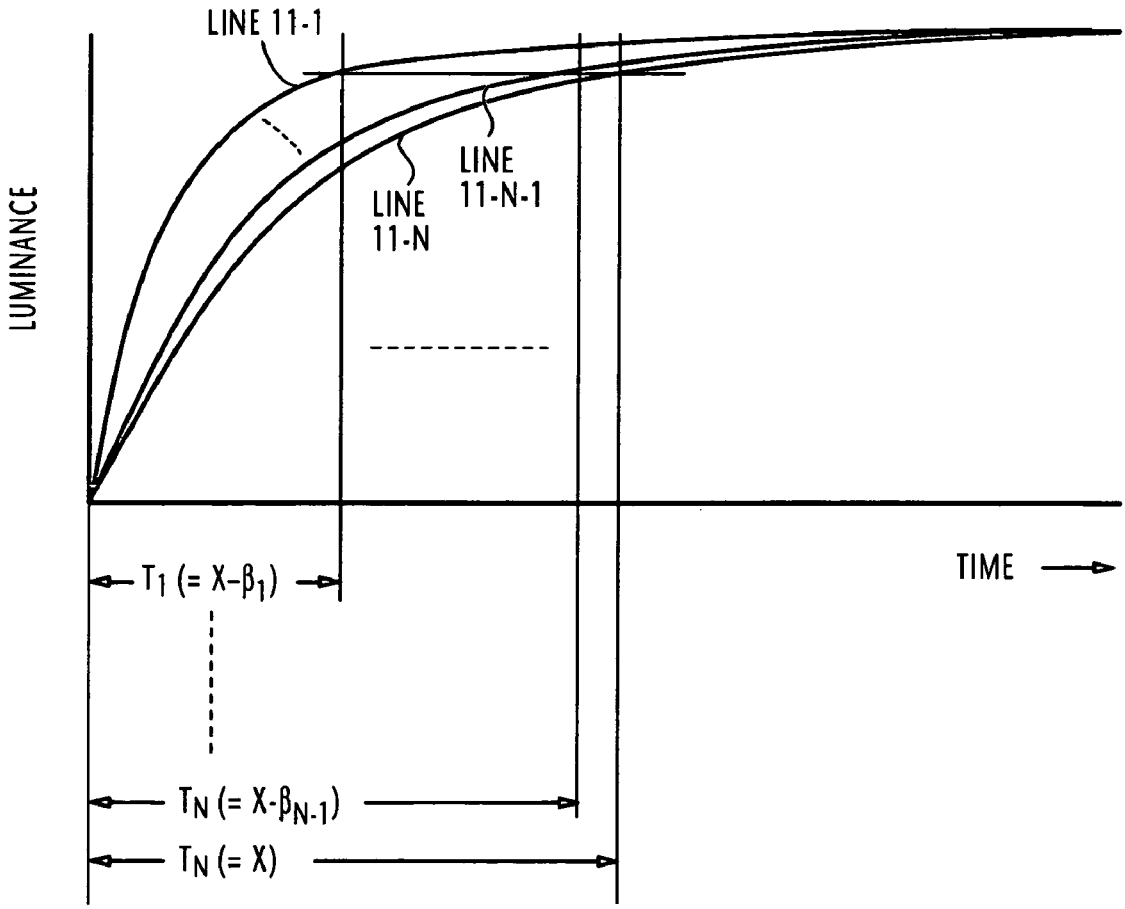
FIG. 9 is a graphic representation of the luminance-versus-time characteristics of the second embodiment of the present invention.

When a line signal of the input video frame is clocked into the column driver 2 in response to a constant-rate start pulse SP and latched in response to a DLP pulse, the row driver 3 selects a row line 11-i and generates a gate control pulse in response to a VCK pulse to drive the selected row line. This gate control pulse terminates in response to a subsequent VOE pulse so that the write-in period $T_i$ for the row line 11-i is equal to $X-\beta_i$, which begins at the trailing edge of the DLP pulse and ends at the leading edge of the VOE pulse. In this manner, the row lines 11-1 through 11-N are successively selected and rendered active for write-in periods $T_1$, . . . , $T_N$, respectively. The distance-related different voltage drops along the column lines are compensated and all liquid crystal cells are charged with substantially equal voltages regardless of their relative positions to the column driver 2, as graphically shown in FIG. 9.

Figure 10:
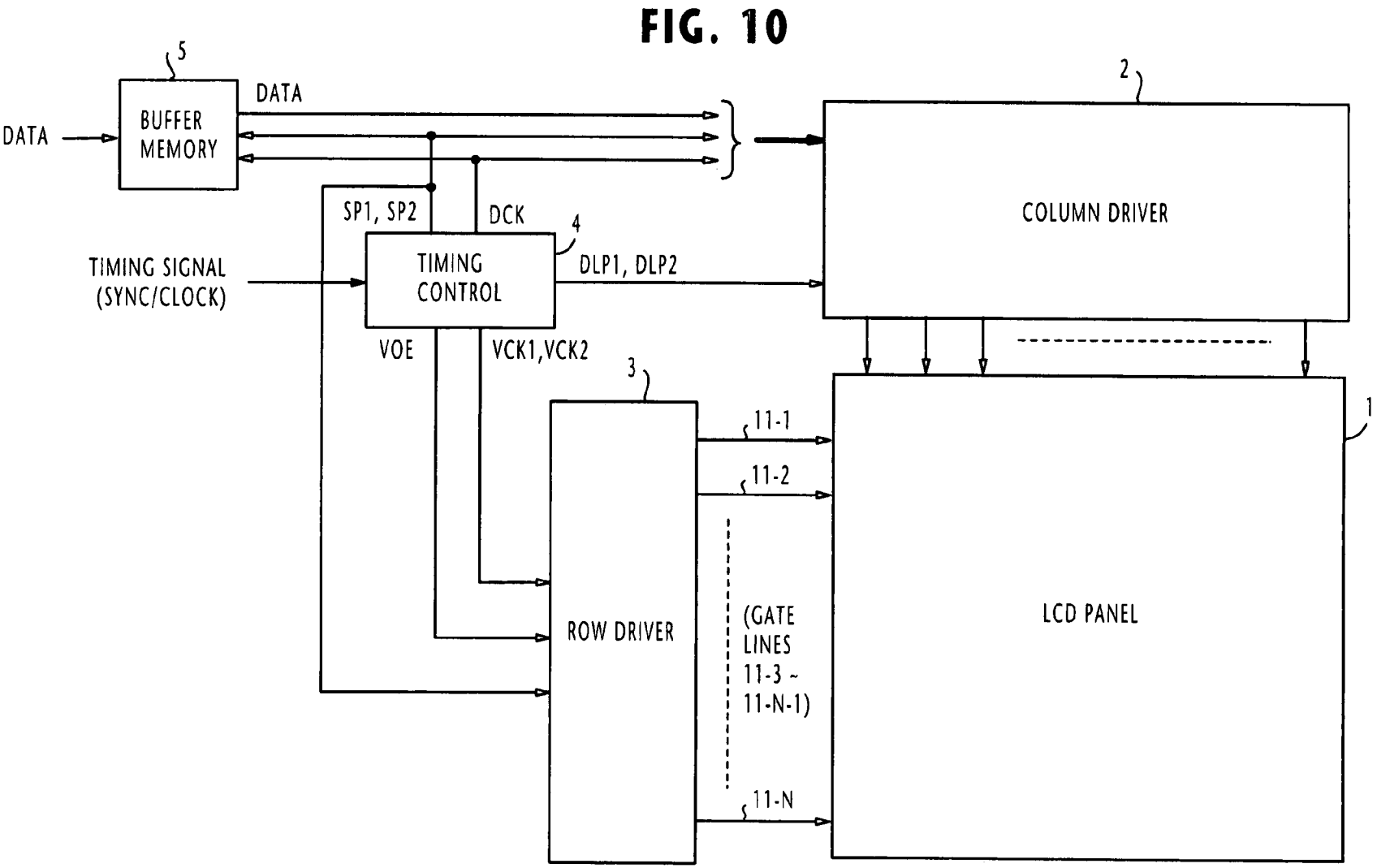
FIG. 10 is a block diagram of an LCD drive circuit according to a third embodiment of the present invention.

A third embodiment of the present invention is shown in FIG. 10. This embodiment is a combined form of the previous embodiments. Accordingly, the timing controller 4 of the third embodiment is of similar configuration to that of FIG. 3 modified according to FIG. 7.

Figure 11:
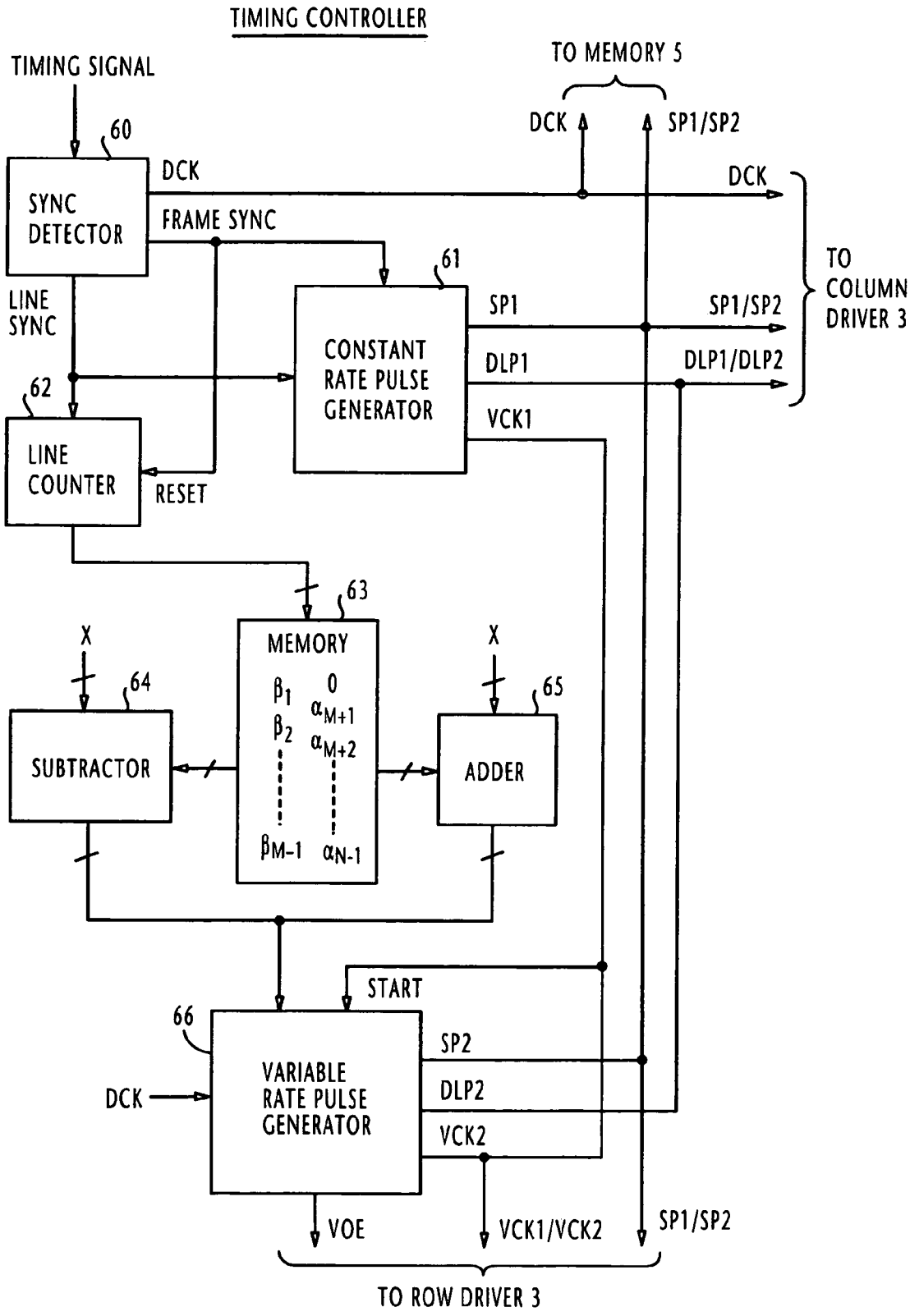
FIG. 11 is a block diagram of the timing controller of FIG. 10.

As illustrated in FIG. 11, the timing controller of the third embodiment comprises sync detector 60 for discriminating the input clock and sync timing signals to detect the frame sync and line sync timing of the input video frame and the dot clock pulse DCK. Constant-rate pulse generator 61 responds to the detected frame and line sync timing for producing SP1, DLP1 and VCK1 pulses at constant intervals. Line counter 62, which is reset by a frame sync, increments a count number each time a line sync is detected and provides a binary line-count number to a memory 63. Write-in subtractive timing values $\beta_1, \beta_2, \ldots, \beta_{M-1}$ and write-in additive timing values 0, $\alpha_{M+1}, \alpha_{M+2}, \ldots, \alpha_{N-1}$ are stored in the memory 63 respectively corresponding to row lines 11-1, 11-2, . . . , 11-M−1, 11-M, 11-M+1, 11M+2, . . . , 11-N.

During a first portion of each video frame, each subtractive timing value is read from the memory 63 in response to a corresponding line-count number and supplied to a subtractor 64 where the subtractive timing value is subtracted from the nominal value X. The binary output of the subtractor 64 is used to preset a variable rate pulse generator 66. Variable rate pulse generator 66 responds to a constant-rate VCK1 pulse by starting the count of DCK pulses and generates a variable-rate VOE pulse when the count number equals the preset value. The variable-rate VOE pulse and the constant rate SP1 and VCK1 pulses are supplied to the row driver 3 and the constant-rate SP1 and DLP1 pulses are supplied to the column driver 2 along with the input video frame (data) and DCK pulse. Buffer memory 5 is supplied with the DCK pulse and the constant-rate start pulse SP1.

During a second portion of the video frame, each additive timing value is read from the memory 63 in response to a corresponding line-count number and supplied to an adder 65 where the additive timing value is summed with the nominal value X. The binary output of the adder 65 is used to preset the variable rate pulse generator 66. When the preset value is reached, the variable rate pulse generator 66 produces pulses SP2, DLP2 and VCK2 at variable intervals, instead of the VOE pulse. The variable-rate SP2, and VCK2 pulses are supplied to the row driver 3 and the SP2 and DLP2 pulses are supplied to the column driver 2 along with the input video frame and DCK pulse. Buffer memory 5 is supplied with the DCK pulse and the variable-rate start pulse SP2.

Figure 12:
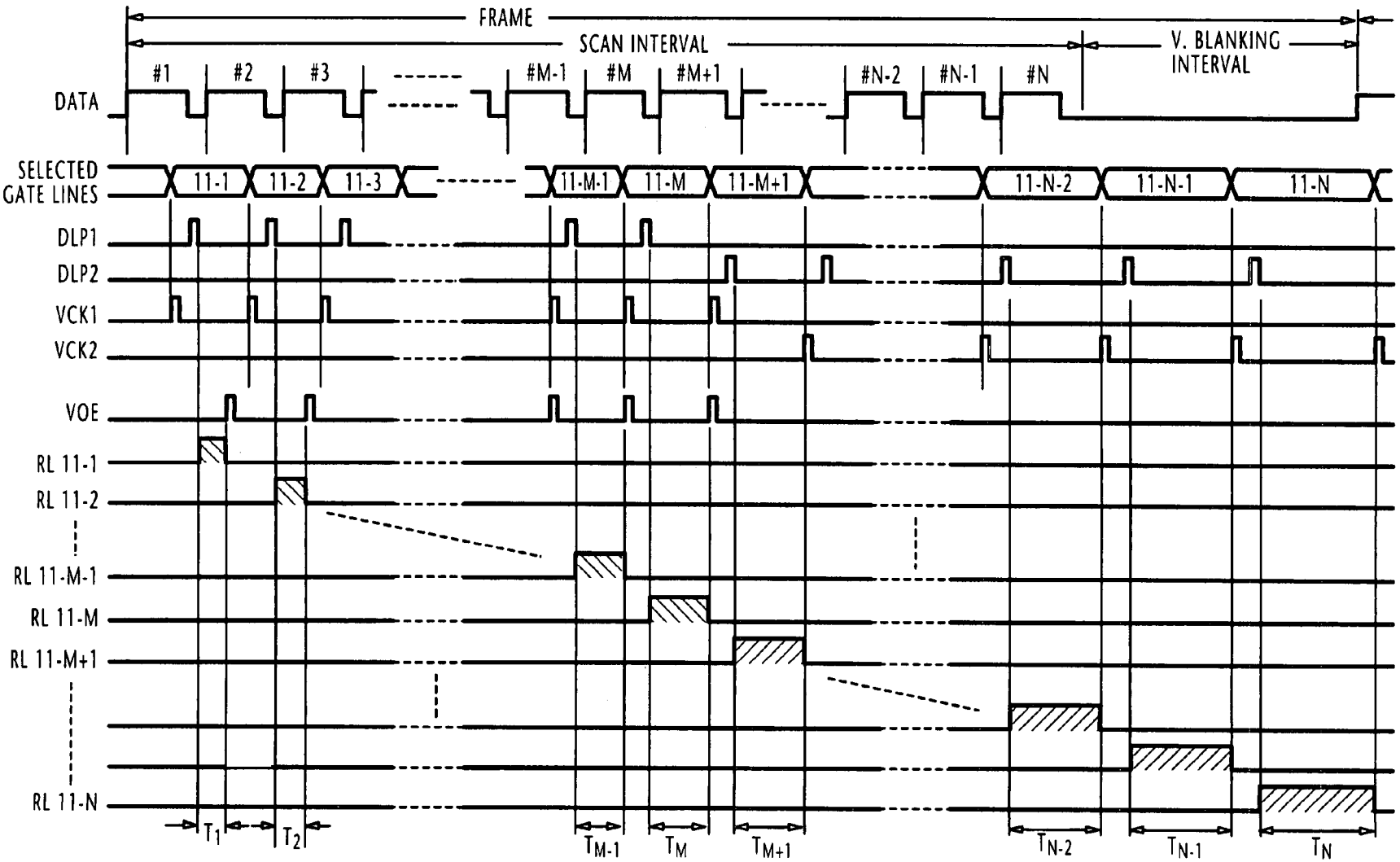
FIG. 12 is a timing diagram of the operation of FIG. 10.

The operation of the third embodiment of the present invention proceeds according to the timing diagram of FIG. 12.

During the first portion of a frame interval, each line signal of the input video frame is clocked into the column driver 2 in response to a constant-rate start pulse SP1 and latched in response to a DLP1 pulse, and the row driver 3 selects a row line 11-i and generates a gate control pulse in response to a constant-rate VCK1 pulse to drive the selected row line. This gate control terminates in response to a subsequent VOE pulse so that the write-in period $T_i$ is equal to $X-\beta_i$. In this manner, the row lines 11-1 through 11-M−1 are successively selected and rendered active for write-in periods $T_1, \ldots, T_{M-1}$, respectively.

During the second portion of the frame interval, each line signal of the input video frame is clocked into the column driver 2 in response to a variable-rate start pulse SP2 and latched in response to a variable-rate DLP2 pulse, the row driver 3 selects a row line 11-i and generates a gate control pulse in response to a variable-rate VCK2 pulse to drive the selected row line. This gate control pulse terminates in response to a subsequent VCK2 pulse so that the write-in period $T_i$ is equal to $X-\alpha_i$. In this manner, the row lines 11-M through 11-N are successively selected and rendered active for write-in periods $T_M, \ldots, T_N$, respectively.

Figure 13:
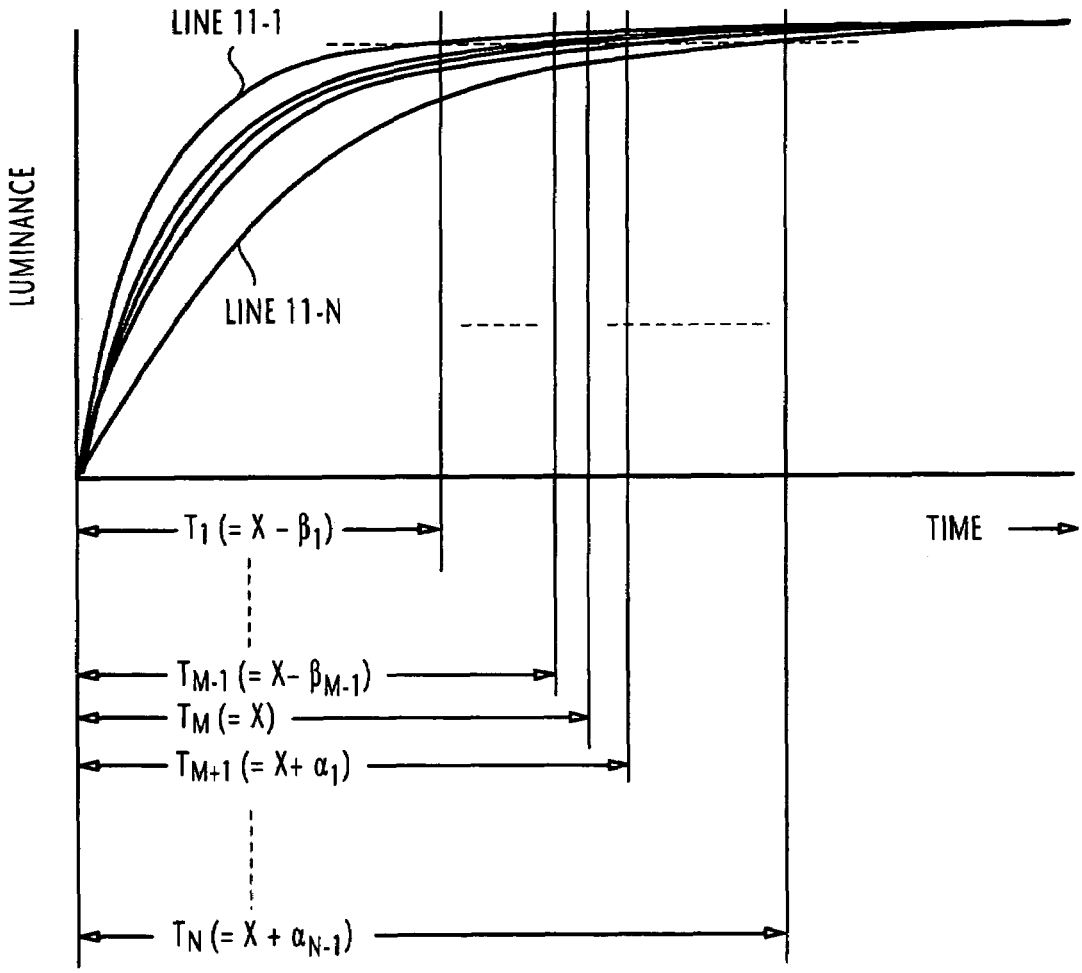
FIG. 13 is a graphic representation of the luminance-versus-time characteristics of the third embodiment of the present invention.

As shown in FIG. 13, the write-in periods for row lines 11-1 to 11-M−1 are $T_1=X-\beta_1$, $T_2=X-\beta_2$, . . . , $T_{M-1}=X-\beta_{M-1}$, respectively, and the write-in periods for row lines 11-M to 11-N are $T_M=X$, $T_{M+1}=X+\alpha_1, \ldots, T_N=X+\alpha_{N-1}$, respectively, where $\beta_1 \geqq \beta_2 \geqq, \ldots \geqq \beta_{M-1}$ and $\alpha_1 \leqq \alpha_2 \leqq \ldots, \alpha_{N-2} \leqq \alpha_{N-1}$.

What is claimed is:

1. A liquid crystal display apparatus comprising:

a liquid crystal display panel comprising a matrix array of transistors and a matrix array of liquid crystal cells respectively connected to said transistors, said transistors being respectively connected to intersections of a plurality of column lines and a plurality of row lines for respectively activating the liquid crystal cells; and a driving circuit for successively generating a plurality of write-in voltages, successively selecting each of said row lines and supplying said write-in voltages from end points of the column lines to the liquid crystal cells of the selected row line for a period corresponding to a distance from the selected row line to said end points; wherein said period corresponding to a distance increases as a function of the distance from the selected row line to said end points.

2. The liquid crystal display apparatus of claim 1, wherein said driving circuit comprises:

a buffer memory for storing a video frame;

a timing controller for generating first and second timing signals;

a column driver for receiving a line signal from said memory, converting said line signal to said write-in voltages and supplying said write-in voltages to said column lines in response to said first timing signal; and a row driver for successively selecting each of said row lines for an interval between successive ones of said second timing signal and supplying said write-in voltages to the liquid crystal cells of the selected row line for a write-in period which runs from said first timing signal to said second timing signal, said timing controller generating said first timing signal at intervals increasingly variable as a function of the distance from the selected row line to said column driver and generating said second timing signal at said increasingly variable intervals.

3. The liquid crystal display apparatus of claim 2, wherein said write-in period is increasingly variable from a nominal value.

4. The liquid crystal display apparatus of claim 2, wherein said timing controller comprises:

a memory for storing a plurality of additive values, each of the additive values corresponding to a distance from the selected row line to said column driver;

a line counter for incrementing a count number in response to a line signal and reading an additive variable from said memory corresponding to the count number;

an adder for summing the read variable with a constant value; and a variable-rate pulse generating means for producing each of said first and second timing signals at intervals corresponding to an output signal of said adder.

5. The liquid crystal display apparatus of claim 1, wherein said driving circuit comprises:

a timing controller for generating a first, second and third timing signals;

a column driver for converting a line signal to said write-in voltages and supplying said write-in voltages to said column lines in response to the first timing signal;

a row driver for successively selecting one of said row lines for an interval between successive ones of said second timing signal and supplying said write-in voltages to the liquid crystal cells of the selected row line for a write-in period which runs from said first timing signal to said third timing signal, said timing controller generating each of said first and second timing signals at constant intervals and generating said third timing signal at intervals increasingly variable as a function of the distance from the selected row line to said column driver.

6. The liquid crystal display apparatus of claim 5, wherein said write-in period is variable from a less-than-nominal value to a nominal value.

7. The liquid crystal display apparatus of claim 5, wherein said timing controller comprises:

a memory for storing a plurality of subtractive values, each of the subtractive values corresponding to a distance from the selected row line to said column driver;

a line counter for incrementing a count number in response to a line signal and reading a subtractive value from said memory corresponding to the count number;

a subtractor for subtracting the read subtractive value from a constant value;

a constant-rate pulse generating means for producing each of said first and second timing signals at constant intervals; and a variable-rate pulse generating means for producing said third timing signal at intervals corresponding to an output signal of said subtractor.

8. The liquid crystal display apparatus of claim 1, wherein said driving circuit comprises:

a buffer memory for storing a video frame;

a timing controller for generating first, second, third, fourth and fifth timing signals;

a column driver for receiving a line signal from said memory, converting said line signal to said write-in voltages and supplying said write-in voltages to said column lines in response to said first timing signal during a first portion of a frame interval and in response to said fourth timing signal during a second portion of the frame interval;

a row driver for successively selecting one of said row lines for an interval between successive ones of said second timing signal during said first portion of the frame interval and supplying said write-in voltages to the liquid crystal cells of the selected row line for a write-in period which runs from said first timing signal to said third timing signal, successively selecting one of said row lines for an interval between successive ones of said fifth timing signal during said second portion of the frame interval, and supplying said write-in voltages to the liquid crystal cells of the selected row line for a write-in period which runs from said fourth timing signal to said fifth timing signal, said timing controller generating, during said first portion of the frame interval, each of said first and second timing signals at constant intervals and said third timing signal at intervals increasingly variable as a function of the distance from the selected row line to said column driver and generating, during said second portion of the frame interval, each of said fourth and fifth timing signals at intervals increasingly variable as a function of the distance from the selected row line to said column driver.

9. The liquid crystal display apparatus of claim 8, wherein said write-in period of said first portion of the frame interval is increasingly variable from a less-than-nominal value to a nominal value and the said write-in period of said second portion of the frame interval is increasingly variable from said nominal value.

10. The liquid crystal display apparatus of claim 8, wherein said timing controller comprises:

a memory for storing a plurality of subtractive values and a plurality of additive values, each of said subtractive and additive values corresponding to a distance from the selected row line to said column driver;

a line counter for incrementing a count number in response to a line signal and reading one of said subtractive values from said memory corresponding to the count number during said first portion of the frame interval and reading one of said additive values from said memory corresponding to the count number during said second portion of the frame interval;

a subtractor for subtracting from a constant value the subtractive value which is read from said memory during said first portion of the frame interval;

an adder for summing said constant value with the additive value which is read from said memory during said second portion of the frame interval;

a constant-rate pulse generating means for producing each of said first and second timing signals at constant intervals; and a variable-rate pulse generating means for producing said third timing signal at intervals corresponding to an output signal of said subtractor and producing each of said fourth and fifth timing signal at intervals corresponding to an output signal of said adder.

11. The liquid crystal display apparatus of claim 1, wherein said plurality of write-in voltages are of a constant applied voltage.

12. The liquid crystal display apparatus of claim 1, wherein said period is a variable period that varies based on the distance from the selected row line to said end points.

13. A method of driving a liquid crystal display, wherein the liquid crystal display panel comprises a matrix array of transistors and a matrix array of liquid crystal cells respectively connected to said transistors, said transistors being respectively connected to intersections of a plurality of column lines and a plurality of row lines for respectively activating the liquid crystal cells, the method comprising the steps of:

a) generating a plurality of write-in voltages;

b) successively selecting one of said row lines; and c) successively supplying said write-in voltages from end points of the column lines to the liquid crystal cells of the selected row line for a write-in period corresponding to the distance from the selected row line to said end points; wherein said period corresponding to a distance increases as a function of the distance from the selected row line to said end points.

14. The method of claim 13, wherein step (a) comprises the step of buffering a line signal in a memory and wherein step (c) comprises the step of increasingly varying said write-in period from a nominal value as a function of said distance.

15. The method of claim 13, wherein step (c) comprises the step of increasingly varying said write-in period as a function of said distance in a range from a less-than-nominal value to a nominal value.

16. The method of claim 13, wherein step (a) comprises the step of buffering a line signal in a memory and wherein step (d) comprises the step of increasingly varying said write-in period as a function of said distance in a range from a less-than-nominal value to a nominal value during a first portion of a frame interval and increasingly varying said write-in period as a function of said distance from the nominal value.

17. A driving circuit for a liquid crystal display which comprises a matrix array of transistors and a matrix array of liquid crystal cells respectively connected to said transistors, said transistors being respectively connected to intersections of a plurality of column lines and a plurality of row lines for respectively activating the liquid crystal cells, the driving circuit comprising means for successively generating a plurality of write-in voltages, successively selecting each of said row lines and supplying said write-in voltages from end points of the column lines to the liquid crystal cells of the selected row line for a period corresponding to a distance from the selected row line to said end points; wherein said period corresponding to a distance increases as a function of the distance from the selected row line to said end points.

18. The driving circuit of claim 17, wherein said means comprises:

a buffer memory for storing a video frame;

a timing controller for generating first and second timing signals;

a column driver for receiving a line signal from said memory, converting said line signal to said write-in voltages and supplying said write-in voltages to said column lines in response to said first timing signal; and a row driver for successively selecting each of said row lines for an interval between successive ones of said second timing signal and supplying said write-in voltages to the liquid crystal cells of the selected row line for a write-in period which runs from said first timing signal to said second timing signal, said timing controller generating said first timing signal at intervals increasingly variable as a function of the distance from the selected row line to said column driver and generating said second timing signal at said increasingly variable intervals.

19. The driving circuit of claim 18, wherein said write-in period is increasingly variable from a nominal value.

20. The driving circuit of claim 18, wherein said timing controller comprises:

a memory for storing a plurality of additive values, each of the additive values corresponding to a distance from the selected row line to said column driver;

a line counter for incrementing a count number in response to a line signal and reading an additive variable from said memory corresponding to the count number;

an adder for summing the read variable with a constant value; and a variable-rate pulse generating means for producing each of said first and second timing signals at intervals corresponding to an output signal of said adder.

21. The driving circuit of claim 17, wherein said driving circuit comprises:

a timing controller for generating a first, second and third timing signals;

a column driver for converting a line signal to said write-in voltages and supplying said write-in voltages to said column lines in response to the first timing signal;

a row driver for successively selecting one of said row lines for an interval between successive ones of said second timing signal and supplying said write-in voltages to the liquid crystal cells of the selected row line for a write-in period which runs from said first timing signal to said third timing signal, said timing controller generating each of said first and second timing signals at constant intervals and generating said third timing signal at intervals increasingly variable as a function of the distance from the selected row line to said column driver.

22. The driving circuit of claim 21, wherein said write-in period is variable from a less-than-nominal value to a nominal value.

23. The driving circuit of claim 21, wherein said timing controller comprises:

a memory for storing a plurality of subtractive values, each of the subtractive values corresponding to a distance from the selected row line to said column driver;

a line counter for incrementing a count number in response to a line signal and reading a subtractive value from said memory corresponding to the count number;

a subtractor for subtracting the read subtractive value from a constant value;

a constant-rate pulse generating means for producing each of said first and second timing signals at constant intervals; and a variable-rate pulse generating means for producing said third timing signal at intervals corresponding to an output signal of said subtractor.

24. The driving circuit of claim 17, wherein said means comprises:

a buffer memory for storing a video frame;

a timing controller for generating a first, second, third, fourth and fifth timing signals;

a column driver for receiving a line signal from said memory, converting said line signal to said write-in voltages and supplying said write-in voltages to said column lines in response to said first timing signal during a first portion of a frame interval and in response to said fourth timing signal during a second portion of the frame interval;

a row driver for successively selecting one of said row lines for an interval between successive ones of said second timing signal during said first portion of the frame interval and supplying said write-in voltages to the liquid crystal cells of the selected row line for a write-in period which runs from said first timing signal to said third timing signal, successively selecting one of said row lines for an interval between successive ones of said fifth timing signal during said second portion of the frame interval, and supplying said write-in voltages to the liquid crystal cells of the selected row line for a write-in period which runs from said fourth timing signal to said fifth timing signal, said timing controller generating, during said first portion of the frame interval, each of said first and second timing signals at constant intervals and said third timing signal at intervals increasingly variable as a function of the distance from the selected row line to said column driver and generating, during said second portion of the frame interval, each of said fourth and fifth timing signals at intervals increasingly variable as a function of the distance from the selected row line to said column driver.

25. The driving circuit of claim 24, wherein said write-in period of said first portion of the frame interval is increasingly variable from a less-than-nominal value to a nominal value and the said write-in period of said second portion of the frame interval is increasingly variable from said nominal value.

26. The driving circuit of claim 24, wherein said timing controller comprises:

a memory for storing a plurality of subtractive values and a plurality of additive values, each of said subtractive and additive values corresponding to a distance from the selected row line to said column driver;

a line counter for incrementing a count number in response to a line signal and reading one of said subtractive values from said memory corresponding to the count number during said first portion of the frame interval and reading one of said additive values from said memory corresponding to the count number during said second portion of the frame interval;

a subtractor for subtracting from a constant value the subtractive value which is read from said memory during said first portion of the frame interval;

an adder for summing said constant value with the additive value which is read from said memory during said second portion of the frame interval;

a constant-rate pulse generating means for producing each of said first and second timing signals at constant intervals; and a variable-rate pulse generating means for producing said third timing signal at intervals corresponding to an output signal of said subtractor and producing each of said fourth and fifth timing signals at intervals corresponding to an output signal of said adder.

* * * * *